United States Patent [19]

Stine et al.

[11] Patent Number: 4,961,839

[45] Date of Patent: Oct. 9, 1990

[54] HIGH CONVERSION HYDROCRACKING PROCESS

[75] Inventors: Laurence O. Stine, Western Springs; Mark E. Reno, Villa Park; William H. Munro, Lincolnshire; Simon J. Hamper, Lisle, all of Ill.

[73] Assignee: UOP, Des Plaines, Ill.

[21] Appl. No.: 197,239

[22] Filed: May 23, 1988

[51] Int. Cl.[5] ..... C10G 65/12

[52] U.S. Cl. ..... 208/102; 208/262.1; 208/262.5

[58] Field of Search ..... 208/48 R, 59, 95, 100, 208/102, 89, 262.1, 262.5

[56] References Cited

U.S. PATENT DOCUMENTS

| | | | |
|---|---|---|---|
| 3,119,765 | 1/1964 | Corneil et al. | 208/59 X |
| 3,132,089 | 5/1964 | Hass et al. | 208/59 |
| 3,471,397 | 2/1967 | Fortman | 208/111 |
| 3,472,758 | 10/1969 | Stine et al. | 208/59 |
| 3,549,519 | 12/1970 | Munro et al. | 208/102 X |
| 3,586,619 | 6/1971 | Stine | 208/102 |
| 3,594,309 | 7/1971 | Stolfa | 208/89 |
| 3,598,720 | 8/1971 | Stolfa | 208/89 |
| 3,617,502 | 11/1971 | Stolfa | 208/102 |
| 3,619,407 | 11/1971 | Hendricks et al. | 208/48 R |
| 3,622,498 | 11/1971 | Stolfa | 208/102 X |
| 4,197,184 | 4/1980 | Munro et al. | 208/89 |
| 4,411,768 | 10/1983 | Unger et al. | 208/59 |
| 4,447,315 | 5/1984 | Lamb et al. | 208/99 |
| 4,618,412 | 10/1986 | Hudson et al. | 208/59 |
| 4,661,239 | 4/1987 | Steigleder | 208/111 |
| 4,713,167 | 12/1987 | Reno et al. | 208/59 |
| 4,792,390 | 12/1988 | Staggs et al. | 208/89 |

*Primary Examiner*—Glenn Caldarola

*Attorney, Agent, or Firm*—Thomas K. McBride; John F. Spears, Jr.

[57] ABSTRACT

Potential problems associated with the formation of polynuclear aromatic compounds during hydrocracking of residual oils are eliminated by operating at high conversion rates with a high hydrogen concentration followed by a unique separation method. The feed to the final product recovery column is highly vaporized. All of the net bottoms stream of the product recovery column, which is equal to less than 5 vol. percent of the feed, is withdrawn from the process. Only PNA free distillate is recycled.

11 Claims, 1 Drawing Sheet

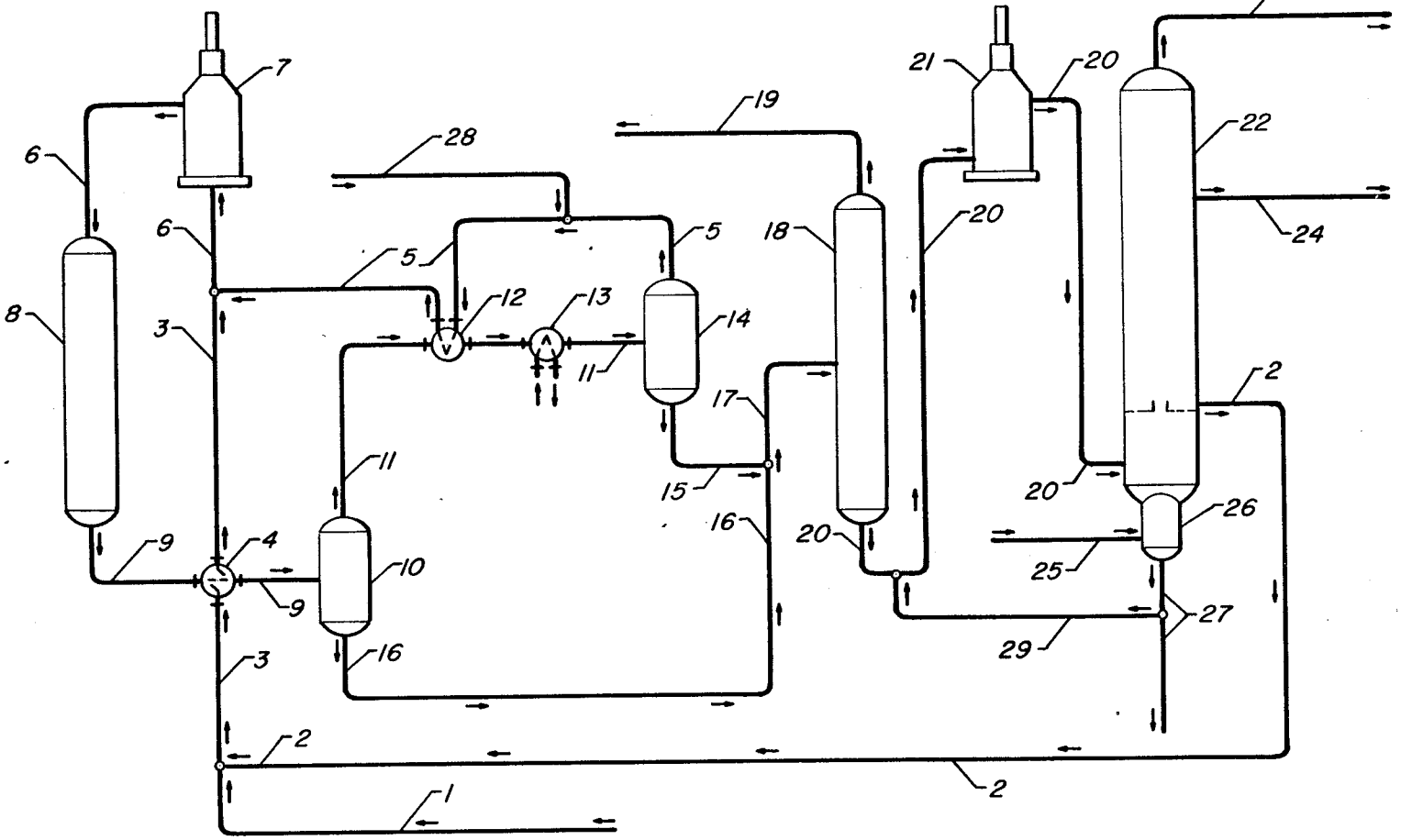
23
24
22
2
26
27
20
20
25
29
21
20
2
18
20
19
17
16
14
5
15
13
11
12
28
5
11
10
16
1
7
4
9
2
3
6
3
9
6
8

HIGH CONVERSION HYDROCRACKING PROCESS

FIELD OF THE INVENTION

The invention relates to that process employed in petroleum refineries referred to as a hydrocracking process. The invention therefore relates to a process wherein a broad boiling point range mixture of hydrocarbons such as a heavy vacuum gas oil is contacted with a hydrocracking catalyst in admixture with hydrogen for the purpose of converting most of the charge material into hydrocarbons having a lower average molecular weight. The subject invention is specifically directed to the fractionation method used to produce a small quantity heavy drag stream and a recycle stream. The subject invention is directly concerned with a method for counteracting the formation and accumulation of polycyclic aromatic compounds within a hydrocracking process unit. These compounds tend to form during certain hydrocracking processes and may accumulate within the reaction zone or in downstream processing equipment. Either occurrence can cause effects detrimental to the operation of the hydrocracking process.

PRIOR ART

Hydrocracking processes are well developed and are used commercially in a number of petroleum refineries for the conversion or upgrading of mixtures of hydrocarbons to more valuable products. Hydrocrackin9 may be employed for the conversion of a light material such as a naphtha to lighter materials such as LPG if market conditions dictate but is more normally applied to the conversion of a relatively heavy or residual material such as a vacuum gas oil to gasoline or diesel fuel. A specific example of a hydrocracking process intended for the production of middle distillates is provided in U.S. Pat. No. 4,661,239 issued to K. Z. Steigleder, which is incorporated herein by reference.

U.S. Pat. No. 3,619,407 issued to G. W. Hendricks et al. is relevant both for its teaching in regards to the operation of a hydrocracking process and the composition of a hydrocracking catalyst suitable for use therein but also in that it discloses the problem addressed by the subject invention. Specifically, this reference describes the formation of polycyclic aromatic hydrocarbons within the hydrocracking reaction zone, with these compounds being characterized as benzocoronenes in this reference. The reference indicates it is known that these compounds have a limited solubility in the effluent of the hydrocracking zone and may tend to build up in residual or heavy recycle streams present in the process. The reference also indicates these materials may tend to deposit or "plate out" in cooler portions of the overall process flow such as the surface of heat exchangers used to cool a liquid stream containing these materials. The solution to this problem presented by this reference is the withdrawal of a small bleed stream of benzocoronene rich material from the reactor effluent.

U.S. Pat. No. 4,447,315 issued to P. R. Lamb et al. is relevant for its teaching in regard to another solution to the same problem, the formation of polycyclic or polynuclear aromatic compounds (PNA's) within the reaction zone. This reference teaches that the problem may be overcome by passing the recycle stream produced by fractionating the liquid phase material recovered from the reactor effluent through a bed of suitable adsorbent such as activated carbon or alumina. The deleterious polycyclic materials are thereby removed from the recycle stream at a rate sufficient to prevent their concentration from reaching the level at which serious problems occur due to these materials plating out or depositing on the surfaces of process equipment.

U.S. Pat. No. 4,618,412 issued to C. W. Hudson et al. and U.S. Pat. No. 4,411,768 issued to H. Unger et al. are both believed relevant for their teaching of the removal or hydrotreating of the PNA's (polynuclear aromatics) or coke precursors from recycle streams of hydrocracking and hydrogenation reaction zones respectively.

It is well known in the hydrocracking arts that it is often not practical or possible to achieve 100 percent conversion of the feed hydrocarbons to the desired lighter hydrocarbons. Hydrocarbons in the reactor effluent which have boiling points greater than the desired products are therefore in many instances recycled to the reaction zone. This is accomplished by subjecting the liquid phase hydrocarbons recovered from the reactor effluent to fractional distillation. For instance, U.S. Pat. No. 3,472,758 to L. O. Stine et al. illustrates recycling light material to a first reactor while fresh feed and a heavy recycle material are fed to a downstream reactor. U.S. Pat. No. 4,197,184 issued to W. H. Munro et al. also illustrates recycling of heavy hydrocarbons of the product column bottoms stream to a hydrocracking zone.

It is also known to withdraw from the process some or all of the net bottoms stream of the product 5 fractionation column of a hydrocracking process. This bottoms withdrawal can be combined with recycling. For instance, in U.S. Pat. No. 4,713,167 issued to M. E. Reno et al. the net bottoms stream of the product fractionation column may be divided into a portion withdrawn from the 0 process and a portion recycled to a hydrocracking reactor. U.S. Pat. No. 3,132,089 issued to R. H. Hass et al. illustrates the total removal of the bottoms stream of the product column and the recycling of a heavy sidecut stream removed from the product column.

U.S. Pat. No. 3,471,397 issued to J. T. Fortman et al. illustrates yet another hydrocracking process flow. In this process a portion of liquid phase reactor effluent material from a hot separator vessel is recycled to the reactor while the remainder is passed into further separation steps which yield bottoms streams removed from the process.

SUMMARY OF THE INVENTION

The invention is an improved hydrocracking process characterized by operation at conditions which result in high per pass conversion. High per pass conversion is achieved in part by the use of high hydrogen to hydrocarbon ratios in the reaction zone. A second characteristic of the invention is that the high conversion allows the vaporization of a sizeable portion of the material fed to product fractionation column. This in turn facilitates concentrating PNA's produced in the reaction zone into a very small net bottoms stream, which is withdrawn from the process. A third characteristic of the invention is removal of a recycle stream from the product column above the feedpoint. This stream should be substantially free of PNA compounds. PNA compounds are therefore not recycled to the reaction zone.

A broad embodiment of the invention may be characterized as a hydrocracking process which comprises the steps of passing hydrogen, a recycle stream characterized below and a feed stream into a hydrocracking reaction zone, with the feed stream having a 10 volume percent boiling point range above about 316° C. (600° F.), with the reaction zone containing a supported catalyst comprising a metal component chosen from the group consisting of chromium, nickel, cobalt, tungsten, platinum, palladium, and molybdenum, and with the reaction zone being operated at hydrocracking conditions which include a hydrogen circulation rate in excess of 1,777 std $m^3/m^3$ oil (10,000 std $ft^3$ bbl) and which result in a conversion rate above 60 volume percent and cause the production of a reaction zone effluent stream comprising hydrogen, hydrocracking product hydrocarbons including PNA compounds and unconverted hydrocarbons, with at least 90 wt. percent of the hydrocarbonaceous material in the reaction zone effluent stream exiting the reaction zone as vapor; separating hydrogen from the reaction zone effluent stream and producing a liquid phase process stream comprising hydrocracking product hydrocarbons including PNA compounds and unconverted hydrocarbons; passing the process stream into a product fractionation zone after a very high degree of vaporization (above 90 wt.%), with the hydrocarbons entering the product fractionation zone being separated into at least a net bottoms stream comprising PNA compounds and having a flow rate less than 5 volume percent of the feed stream, a heavy distillate stream which is removed from the distillation zone at a point above the feedpoint of the feed stream and which has a flow rate equal to 10 to 40 volume percent of the feed stream, and at least one light distillate stream; withdrawing the entire net bottoms stream from the process; passing substantially all and preferably the entire heavy distillate stream into the reaction zone as said recycle stream; and, recovering the light distillate stream as a product stream of the process.

BRIEF DESCRIPTION OF THE DRAWING

The Drawing is a simplified process flow diagram of a preferred embodiment of the invention wherein hydrocracking feed from line 1 is passed into a reaction zone 8, with the highly vaporized bottoms stream of stripping column 18 passed into product fractionation column 22 and separated into at least a minor bottoms stream of line 27 and the recycle stream of line 2.

DETAILED DESCRIPTION

As evidenced by the references cited above, specifically the U.S. Patents to G. W. Hendricks et al. and P. R. Lamb et al. a processing problem may occur when it is attempted to hydrocrack a heavy or residual oil such as a vacuum gas oil. This problem often arises when the hydrocracking catalyst comprises a zeolitic component as described in more detail below but may also arise in the absence of this component. Under certain conditions, the process tends to produce a small amount of high molecular weight polycyclic aromatic compounds, commonly referred to as PNA's or benzocoronenes. These materials may plate out or foul various parts of the refining equipment as they have a very low solubility level in the product hydrocarbon. They tend to accumulate on the cold surfaces of heat exchangers used to recover heat from the effluent of the hydrocracking reaction zone. The coating caused by PNA deposits decreases the efficiency of the heat recovery step and may lead to undesirably high pressure drops within the heat exchanger. At an extreme the deposits may require termination of the processing in order to clean the heat exchangers. PNA compounds are also believed to have a role in the deactivation of the hydrocracking catalyst by acting as a precursor for the "coke" deposits associated with catalyst deactivation.

It is therefore an objective of the subject invention to provide an improved hydrocracking process by lessening the deleterious effects of PNA compounds produced in the reaction zone. It is a specific objective of the invention to reduce the deactivation of hydrocracking catalyst employed in a hydrocracking process used to convert heavy feeds and which employs a hydrocarbon recycle stream.

The terms "polycyclic aromatic hydrocarbons", "PNA's", and "polynuclear aromatics" are used interchangeably herein to refer to the heavy aromatic hydrocarbons having seven or more "benzene rings" and which are produced in the hydrocracking reaction zone. These compounds have been characterized as benzocoronenes in the Hendricks reference cited above.

The number of rings in these materials is often used to aid in their classification. The exact cut point in defining the minimum number of rings in a PNA as compared to a PNA precursor is open to debate. However, it has been determined that 11-plus ring compounds are the most detrimental in terms of plating out and catalyst deactivation. The concentration of heavier compounds having 9 or more rings per molecule, especially 11-plus ring molecules, is believed to be most important in correlating PNA concentration in recycle or product streams with surface fouling and catalyst deactivation mechanism rates. Lighter polycyclics having 4–6 rings per molecule are referred to herein as "PNA precursors".

Although not ascertained with certainty, it appears that the rate of formation of these compounds in the hydrocracking reaction zone is quite low and that the problems mentioned above normally arise when the process entails the production of a recycle stream containing heavy hydrocarbons recovered from the effluent of the hydrocracking zone. The problems can also occur in oncethrough operations if the feed is very heavy (high boiling) such as a deasphalted oil. The PNA production is believed to occur continuously despite the presence of minor amounts of PNA's in the recycle. Newly produced PNA's accumulate in a heavy bottoms recycle stream and the concentration in the reactor effluent therefore increases with time. The prior art has therefore apparently concentrated on methods of removing the offensive materials from this recycle stream to prevent their buildup within the process. For instance, in the process of Hendricks a small slip stream is removed to control the buildup or concentration of these compounds in the recycle stream. In the process of Lamb, the recycle stream is passed through adsorption zones wherein the polycyclic compounds are removed by contact with a bed of solid adsorbent such as charcoal.

The subject process is especially useful in the production of middle distillate fractions boiling in the range of about 300°–700° F. (149°–371° C.) as determined by the appropriate ASTM test procedure. In addition, it is expected that useful hydrogenation reactions such as hydrodenitrification and hydrodesulfurization will occur simultaneously with hydrocracking of heavier feedstocks. Typical feedstocks include virtually any heavy mineral or synthetic oils and fractions thereof. Thus, such feedstocks as straight run gas oils, vacuum gas oils, demetallized oils, deasphalted vacuum residue, coker distillates, cat cracker distillates, shale oil, tar sand oil, coal liquids, and the like are contemplated. The preferred feedstock will have a boiling point range starting at a temperature above 160° Celsius but would not contain appreciable asphaltenes. Feedstocks with end boiling points under about 800° F. (426° C.) usually do not present the PNA related problems addressed herein. Preferred feedstocks therefore include gas oils having at least 50% volume of their components boiling above 700° F. (371° C.). The hydrocracking feedstock may contain nitrogen usually present as organonitrogen compounds in amounts between 1 ppm and 1.0 wt. %. The feed will normally contain sulfur containing compounds sufficient to provide a sulfur content greater than 0.15 wt. %. It may also contain mono- and/or polynuclear aromatic compounds in amounts of 50 volume percent and higher.

Hydrocracking conditions employed in the subject process are those customarily employed in the art for hydrocracking processes. Hydrocracking reaction temperatures are in the range of 400° to 1200° F. (204°–649° C.), preferably between 600° and 950° F. (316°–510° C.). Reaction pressures are in the range of atmospheric to about 3,500 psi (24,233 kPa), preferably between 200 and 3000 psi (1,480–20,786 kPa). A temperature above about 316° C. and a total pressure above about 4238 kPa (600 psi) are highly preferred. As lower pressures aid vaporization a pressure below 13,890 kPa is highly preferred. Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8,888 std. $m^3/m^3$), preferably between 2,000 and 30,000 scf per barrel of charge (355–5,333 std. $m^3/m^3$).

The reaction zone effluent of a hydrocracking process is typically removed from the catalyst bed, heat exchanged with the feed to the reaction zone and then passed into a vapor-liquid separation zone often referred to as a high pressure separator. Initial cooling can be done prior to this separation. In some instances a hot flash separator is used upstream of the high pressure separator. The vapor phase from the separator(s) is further cooled and if desired treated to remove hydrogen sulfide prior to use as recycle gas. The liquid phase is passed into a fractionation zone.

The subject process is distinguished from the prior art hydrocracking processes by three characteristics. The first of these characteristics is the operation of the reaction zone at conditions which result in a high conversion of the charged material to the desired distillate product. The term "high conversion" is intended to mean herein the conversion of at least 50 wt. percent of the charge or feed material to compounds of lower boiling points such that they are collected or separated into one or more of the product streams removed from the product recovery fractionation zone. It is preferred that the operation of the reaction zone results in a conversion rate above 70 wt. percent. Conversion rates exceeding 80 wt. percent of the charge material (feed stream) are highly preferred and the conversion rate may reach or exceed 90 wt. percent.

These high conversion rates require the utilization of a catalyst having good activity and stability coupled with rather severe operating conditions. The severity of the operating conditions in the subject process is preferably increased by increasing the rate of hydrogen circulation rather than by excessive temperature increases. Therefore, the high conversion characteristic of the subject process is characterized by a high hydrogen circulation rate, with the minimum hydrogen circulation rate being in excess of 1,777 std $m^3/m^3$, which is equivalent to 10,000 std $ft^3$/barrel. Preferably, the hydrogen circulation rate through the reaction zone is between about 2,666 $m^3$/m of oil (15,000 std $ft^3$/barrel) and 3,554 std $m^3/m^3$ oil (20,000 std $ft^3$/barrel). As high hydrogen circulation rates are costly, the optimum circulation rate is the minimum which allows the desired degree of conversion and results in the effluent of the reaction zone being essentially totally vapor as described herein. This gas flow rate is the gas rate as measured by the total amount of recycle and fresh makeup hydrogen admixed into the chargestock stream upstream of the first reactor of the reaction zone. This gas rate therefore does not include any gases added at intermediate points within the reaction zone to adjust operating temperatures or conditions.

The primary purpose of hiqh hydrogen flow rates is to maintain good selectivity to desired distillate boiling range products.

While not wishing to be limited to a specific theory of operation, it is theorized that operating the reaction zone with essentially 100% vapor reactant flow, measured at the outlet, allows the catalyst to function as a chromatographic type support which selectively retains the heavier, possibly liquid phase, hydrocarbons. The usage of high hydrogen circulation rates aids in achieving increased rates of vaporization and enhanced selectivity. It is believed necessary that at least 90 weight percent and preferably 95 wt. percent of the feed hydrocarbonaceous material charged to the reaction zone exits the reaction zone as vapor. It is highly preferred that over 98 wt.% of the hydrocarbonaceous compounds exit the reaction zone as vapor.

The high conversion achieved in the reaction zone is both a characteristic of the process and a necessary precondition for the realization of a second characteristic of the process. This second characteristic of the process is the vaporization of a high percentage of the hydrocarbons charged to the product fractionation column. That is, the feedstream of liquid phase material recovered from the vapor-liquid separation zone or from the stripping column employed to remove light products from the reaction zone effluent stream is passed into the product fractionation column as a stream containing the minimal practical amount of liquid phase hydrocarbons. At least 90 percent of the net feedstream to the product fractionation column must be vaporized prior to passage into this column.

A primary purpose of high conversion in the reaction zone is to allow total vaporization, or as close as required, at reasonable temperatures within the heat transfer lines of the feed heater to the product fractionation zone. A temperature of 700° F. (371° C.) is near the upper limit of desired heater surface temperatures. This requires, for instance, a minimum 70 percent conversion to 700° F. (371° C.) end point products of a vacuum gas oil feed stream.

The terms "product fractionation column" and "product fractionation zone" are intended to refer to the fractional distillation column(s) from which is withdrawn the heaviest distillate product produced in the process for withdrawal from the process as a product. The drag stream is not a distillate stream. The amount of the feedstream to the column which may be vaporized will be dependent upon the capacity and capability of the heating means employed and upon the physical characteristics of the hydrocarbons being heated. That is to say the equipment must be able to input sufficient heat to vaporize the hydrocarbons plus the hydrocarbons must not be of such a heavy or high boiling nature that they cannot be vaporized. It must be recognized that a small percentage of the reaction zone effluent will normally be "unconverted" hydrocarbons. That is, they will be hydrocarbons having boiling points at temperatures above the desired end boiling point of the heaviest product stream removed from the product column. The reaction zone effluent stream and hence the feed to the product fractionation column will also contain polynuclear aromatic compounds produced within the hydrocracking reaction zone. These materials do not readily vaporize under the conditions employed in commercial fractional distillation columns. Therefore, most of the polynuclear aromatics produced in the hydrocracking reaction zone will remain in the liquid phase portion charged to the product fractionation zone and become concentrated in the net drag stream.

It is desired to minimize the portion of the feed to the product fractionation column which is in the liquid phase. It is therefore preferred that less than 5 wt. percent of the net feed to the product fractionation column is liquid phase material, and more preferably less than 2 wt. percent of this material is liquid phase. Liquid flow rates of about 0.5 wt. percent or less are considered optimum.

The passage of a majority of the hydrocarbons into the product fractionation zone as vapor results in an initial separation of the majority of the polynuclear aromatics into the liquid phase material. Therefore, any material derived solely from the vapor phase material will have a greatly reduced concentration of the polynuclear aromatics. If a small amount of separatory ability is provided in the product separation zone to remove PNA's from the vapor phase, then the PNA's are concentrated in the liquid phase material. If possible only the heaviest portion of the unconverted hydrocarbon should be present as liquid phase material upon entrance to the product fractionation column.

The above discussion of the material fed to the product fractionation column is intended to refer to just the material derived directly from the reaction zone effluent stream and which is entering the product fractionation column for the first time. The calculation of the relevant percentages of vapor and liquid phase material therefore does not include any reflux material, pumparound streams, etc. which may be withdrawn from and then again returned to the product fractionation column. The above percentages do however include any part of the reaction zone effluent stream material withdrawn from the product fractionation column and recycled to the reaction zone.

The Drawing illustrates a preferred embodiment of the invention. This depiction of one embodiment of the invention is not intended to exclude from the scope of the invention those other embodiments described herein or which are obvious to those of ordinary skill in the art. Referring now to the Drawing, a heavy vacuum gas oil is charged to the process through line 1 and is admixed with a recycle stream carried by line 2. The resultant admixture of these two liquid phase streams passes through line 3 and is heated in the indirect heat exchange means 4 and then combined with the hydrogen-rich gas stream of line 5. The admixture of charge hydrocarbon, recycle hydrocarbons and hydrogen pass through line 6 and are heated in the fired heater 7 and thereby brought up to the desired inlet temperature for the hydrocracking reaction zone 8. The admixture continues through line 6 into the reaction zone. Within the reaction zone the mixture of hydrocarbons and hydrogen is brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream carried by line 9 which comprises an admixture of the remaining hydrogen which is not consumed in the reaction, light hydrocarbons such as methane, ethane, propane, butane, and pentane formed by the cracking of the feed hydrocarbons, reaction by-products such as hydrogen sulfide and ammonia formed by hydrodesulfurization and hydrodenitrification reactions which occur simultaneously with the hydrocracking reaction plus the desired product hydrocarbons boiling in the gasoline, diesel fuel, or fuel oil boiling point ranges and, in addition any unconverted hydrocarbons boiling above the boiling point ranges of the desired products. The effluent of the hydrocracking reaction zone 8 will therefore comprise an extremely broad and varied mixture of individual compounds. This admixture is first cooled in the feed-effluent heat exchanger 4 and is then passed into a vapor-liquid separation zone 10.

The effluent stream of the hydrocracking zone may contain some liquid phase material. In addition, the cooling which occurs in the feed-effluent heat exchanger 4 will cause the condensation of some hydrocarbons. The material entering the vapor-liquid separation zone 10 will therefore be a mixed phase stream. The vapors entering this zone will be rich in hydrogen and will contain methane, ethane, and other light hydrocarbons including butane, pentane, etc. The gases may also comprise some hydrogen sulfide. The gas stream is removed through line 11 and is further cooled in the heat exchanger 12 and in the cooling means 13. This causes the condensation of additional materials including the bulk of the $C_3+$ hydrocarbons. The cooled material of line 11 is passed into a second vapor-liquid separation zone 14. This zone is preferably a high pressure separator operated at a pressure slightly reduced from that at the reactor outlet. In this zone, the remaining vapors are concentrated into the recycle hydrogen stream of line 5. This recycle stream is somewhat heated in the indirect heat exchange mean 12 and is then admixed with the makeup hydrogen stream of line 28.

Although not shown in the drawing it will be readily apparent to those skilled in the art that the recycle hydrogen stream of line 5 may be passed through hydrogen purification facilities designed to remove hydrogen sulfide. Although not desired it is also possible that a portion of the gas from line 5 may be diverted from the process to allow the removal of light gases such as methane which are not easily condensed. Another feature normally present in a hydrocracking zone which is not illustrated in the drawing is the admixture of liquid phase water into the reaction zone effluent stream coupled with the recovery of liquid phase water from the vapor-liquid or product separator 10. The water removes salts which tend to form from the production of hydrogen sulfide and ammonia within the reaction zone and which could lead to blockages within the processing equipment.

The liquid phase hydrocarbons accumulated within the vapor-liquid separator 10 are withdrawn through line 16 and admixed with the liquid phase hydrocarbons of line 15 withdrawn from the vapor-liquid separation zone 14. This material is passed through line 17 into a stripping column 18. The stripping column is operated at conditions effective to separate the entering hydrocarbons and other materials into a net overhead stream withdrawn through line 19 and a net bottoms stream withdrawn through line 20. The net overhead stream will comprise essentially all of the propane and lower boiling hydrocarbons and other compounds including hydrogen which enter the stripping column. Essentially all of the heavier boiling hydrocarbons are concentrated into the net bottoms stream. The stripping column will employ an overhead reflux means and a reboiler means not shown on the drawing. The use of the stripping column is preferred, although it is not necessary for successful utilization of the inventive concept. Therefore, the stripping column is not necessary and the entire content of line 17 could be passed downstream.

The net bottoms strea of the stripping column is withdrawn through line 20 and passed through a fired heater 21 wherein preferably all but at least 95 wt. percent of the material flowing through line 20 is vaporized. The resultant admixture of vapor and liquid phase hydrocarbons is passed into a lower portion of the product fractionation column 22. The vaporized portion of the material of line 20 passes upward within the fractionation column. Any smaller liquid phase portion will pass downward toward the bottom of the fractionation column. The product fractionation column is operated under conditions such that the hydrocarbons entering via line 20 are separated into at least one light product stream, at least one distillate recycle stream, and a very small net bottoms stream. Preferably at least two light distillate product streams are removed from the product column, such as a stream of naphtha or gasoline boiling range material removed as a net overhead stream of line 23 and a diesel fuel boiling range stream removed through line 24 as a net sidecut stream. The heavy distillate product stream would have a boiling point range between about 260°–538° C., and the light distillate would have a boiling point range below about 376° C. The separation of these two materials from the remainder of the hydrocarbons is aided by the provision of a reflux system not shown at the top of the column. The drawing illustrates the removal of a single recycle stream of line 2. The invention is not, however, so limited and two or more recycle streams may be withdrawn from the product fractionation column. In this instance, the material of line 2 will have a boiling point range lying above that of the desired product diesel fuel of line 24.

A small portion of the material which enters the fractionation column descends into a stub column 26, a reduced diameter stripping section, and is therein contacted with stripping steam from line 25 in addition to any other reboiling means provided within the column. The objective of adding steam is the removal from the net bottoms stream of hydrocarbons of a suitable boiling range for inclusion in either the recycle stream of line 2 or one of the product streams. This plus the high degree of vaporization of the feed to the column results in the production of a very small net bottoms stream removed through line 27. This net bottoms stream is totally withdrawn from the process, with no portion of the hydrocarbon fraction withdrawn from the fractionation column below the feed point being recycled to the hydrocracking reaction zone.

It is a basic characteristic of the subject invention that the net bottoms stream comprises a very small percentage of the feedstream. This very small stream should contain at least 40 mole percent of the total PNA compounds (6-plus benzene rings) which enter the product distillation column. The net bottoms stream should contain over 85mole percent of the PNA compounds containing more than 11 benzene rings. Preferably, the net bottoms stream has a flowrate less than about 5 volume percent of the feedstream. More preferably the flowrate of the net bottoms stream of the product column is less than 2 volume percent of the flowrate of the feedstream.

A small slipstream of bottoms material of line 27 may optionally be passed through line 29. The purpose of this would be to ensure the presence of some liquid within the heater tubes of heater 21, which is desirable to prolong heater tube life. Another option, which is not illustrated on the drawing is the usage of a product fractionation zone comprising more than one column. For instance, when an existing hydrocracking process unit is being adapted to practice the subject invention the existing product fractionation column may have to be augmented by added equipment. In this particular instance, it is preferred to add a short column, often called a stub column, upstream of the existing or main product fractionation column.

The flows shown in the Drawing would be slightly modified when such an external stub column is used. Preferably the net drag stream removed from the process is a portion of the bottoms liquid withdrawn from the bottom of the stub column. A second portion of this bottoms liquid is preferably recycled to the inlet of the upstream fired heater and admixed with the charge stream to the fractionation zone. The purpose of this heavy liquid recycle is, as before, to keep the heater coils "wet". The hot highly vaporous effluent of the heater would be passed directly into the stub column. This column has trays or packing to provide separation via refluxed vapor-liquid contacting. As the PNA's and HPNA's have some definite volatility in these circumstances refluxed contacting media is provided above the stub column to reduce their presence in the overhead vapor passed into the main column of the product fractionation zone. Stripping steam is preferably injected into the bottom of the stub column to lessen the presence of distillate boiling range hydrocarbons in the bottoms liquid. The stub column should be provided with internal contacting devices equivalent to three theoretical stages above the feed point and at least one theoretical stage below the feed point to the column. A portion of the bottoms liquid from the main column is preferably passed into the upper section of the stub column to provide reflux liquid. A second portion of the bottoms liquid from the main column is returned to the reaction zone as the recycle stream of the process. Steam is preferably injected into the bottom of the main column to aid separation. In this embodiment, the recycle stream is not removed from the main column as a sidecut stream. However, as it is derived from material removed from the stub column in the overhead vapor the bottoms of the main column can be considered a distillate material. This can also be visualized as just the result of an alternative physical arrangement which has the stub column located alongside the main column rather than below it as illustrated in the Drawing.

Several different types of hydrocracking catalysts will function effectively in the subject process. For instance, the metallic hydrogenation components can be supported on a totally amorphous base or on a base comprising an admixture of amorphous and zeolitic materials. Many hydrocracking catalysts are prepared using one starting material having the essential X-ray powder diffraction pattern of zeolite Y set forth in U.S. Pat. No. 3,130,007. The starting material may be modified by techniques known in the art which provide a desired form of the zeolite. Thus, modification techniques such as hydrothermal treatment at increased temperatures, calcination, impregnation, or reaction with an acidity strength inhibiting specie, crystallization and any combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 Angstroms.

A zeolitic type hydrocracking composite containing no amorphous material is possible but it is preferred that zeolitic catalysts comprise between 2 wt. % and 20 wt. % of the Y-type zeolite, and preferably between 2 wt. % and 10 wt. %. The zeolitic catalyst composition should also comprise a porous refractory inorganic oxide matrix which may form between 2 and 98 wt. %, and preferably between 5 and 95 wt. % of the support of the finished catalyst composite. The matrix may comprise any known refractory inorganic oxide such as alumina, magnesia, silica, titania, zirconia, silica-alumina and the like and combinations thereof.

A preferred matrix comprises silica-alumina or alumina. The most preferred matrix comprises a mixture of silica-alumina and alumina wherein said silica-alumina comprises between 5 and 45 wt. % of said matrix. It is also preferred that the support comprises from about 5 wt. % to about 45 wt. % alumina.

The silica-alumina component may be produced by any of the numerous techniques which are rather well defined in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical pH or by treating the carrier with various inorganic or organic reagents.

A finished catalyst for utilization in the subject hydrocracking process should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2$/gm are greatly preferred.

The alumina component of the hydrocracking catalyst may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The precise physical characteristics of the catalyst such as shape and surface area are not considered to be limiting upon the utilization of the present invention. The catalyst may, for example, exist in the form of pills, pellets, granules, broken fragments, spheres, or various special shapes such as trilobal extrudates, disposed as a fixed bed within a reaction zone. Alternatively, the catalyst may be prepared in a suitable form for use in moving bed reaction zones in which the hydrocarbon charge stock and catalyst are passed either in countercurrent flow or in co-current flow. Another alternative is the use of fluidized or ebulated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The catalyst particles may be prepared by any known method in the art including the well-known oil drop and extrusion methods.

Although the hydrogenation components may be added before or during the forming of the support, hydrogenation components are preferably composited with the catalyst by impregnation after the selected zeolite and/or amorphous inorganic oxide materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on the preparation of suitable hydrocracking may be obtained by reference to U.S. Pat. Nos. 4,422,959; 4,576,711; 4,661,239; 4,686,030; and, 4,695,368 which are incorporated herein by reference.

Hydrogenation components contemplated are those catalytically aotive components selected from Group VIB and Group VIII metals and their compounds. Generally, the amount of hydrogenation components present in the final catalyst composition is small compared to the quantity of the other above-mentioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated include one or more metals chosen from the group consisting of molybdenum, tungsten, chromium, iron, cobalt, nickel, platinum, palladium, iridium, osmium, rhodium, rudinium and mixtures thereof.

The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the catalyst. Usually phosphorus is present in the catalyst in the range of 1 to 30 wt. % and preferably 3 to 15 wt. % calculated as $P_2O_5$ In addition, boron may also be present in the catalytic composite.

EXAMPLE 1

The following example is based upon a flowscheme similar to that shown in the drawing. The results listed for this commercial scale unit are derived from pilot plant test results and from experience obtained in the operation of commercial hydrocracking process units in which a similar feed is processed to yield the same products. The data is presented in terms of results expected from an existing commercial unit modified in accordance with the invention and using a commercially available catalyst.

The feed stream is a vacuum gas oil derived from light Arabian crude. The feed stream has the properties set out in Table 1. The objective of the operation is to maximize the production of 385° C. (725° F.) end point distillate. The product distribution is given in Table 2.

TABLE 1

| Feed Properties | |
|---|---|
| °API | 21.6 |
| Sp. Gravity | 0.9242 |
| Wt. % Sulfur | 2.45 |
| Total N, ppm | 900 |
| Con. Carbon, wt. % | 0.49 |
| $C_7$ Insol, wt. % | <0.05 |
| Ni & V, wt. ppm | 0.4 |
| Initial BP °C. | 392 |
| 50% BP °C. | 456 |
| End BP °C. | 583 |

TABLE 2

| | Product Distribution | | |
|---|---|---|---|
| | Wt. % | Vol. % | API Gravity |
| $NH_3$ | 0.11 | | |
| $H_2S$ | 2.60 | | |
| $C_1$ | 0.30 | | |
| $C_2$ | 0.44 | | |
| $C_3$ | 0.93 | | |
| $C_4$ | 1.71 | 2.74 | |
| $C_5$ | 2.09 | 3.08 | |
| $C_6$ | 2.75 | 3.69 | |
| $C_7$–149° C. | 5.67 | 6.99 | 57.3 |
| 149–288° C. | 43.88 | 49.84 | 42.4 |
| 288–385° C. | 41.49 | 45.28 | 35.6 |
| Total | 101.97 | 111.62 | |

A single stage (one reactor) reaction zone is employed. The pressure, as measured at the outlet of the reactor, is maintained at 17,341 kPa (2500 psig). The reactor is operated with an inlet temperature of 385° C. (725° F.) at the start of the run (SOR) which increases to 413° C. (775° F.) at the end of operations. As per the subject invention, the combined feed ratio (fresh feed plus recycle) is set at 1.2. The reaction zone is operated at a liquid hourly space velocity based on fresh feed of 0.96 $hr^{-1}$. The total flow rate of hydrogen to the reactor based on fresh feed is 5,330 std $m^3/m^3$ (30,000 SCFB) to maintain high conversion. An additional 675 std $m^3/m^3$ (3,800 SCFB) of hydrogen is employed as quench between catalyst beds. The recycle hydrogen stream contains over 85 mole percent hydrogen.

The catalyst employed is a commercially available hydrocracking catalyst. The catalyst comprises an admixture of extruded silica and alumina with nickel and molybdenum being added to the support to provide 11.5 wt. % active metals. A net bottoms stream of about 0.5 vol of the feed is withdrawn from the product column and removed from the process.

In comparison, if the reaction zone is operated at more conventional conditions without the rejection of PNA's via a net bottoms stream several changes result. First of all, a 26% increase in the amount by weight of the catalyst is required due to the increased coking rate caused by PNA's entering the reactor in the recycle stream. The "conventional" operating conditions used in this example include a combined feed ratio of 1.6 and a total hydrogen circulation rate of 2487 std $m^3/m^3$ (14,000 SCFB). This is a high circulation rate compared to many conventional processing units. The recycle material is the material boiling above 385° C. (725° F.) and has an API gravity of 34.4. The product distribution stays similar to that provided by the invention, with a slightly higher total $C_4$-plus liquid volume yield of 111.62 volume percent. The total 149°–385° C. (300°–725° F.) product yield is 97.01 percent. However, it must be taken into account that in the process of the subject invention a net bottoms stream having a flowrate equal to 0.5 vol % of the feed is withdrawn from the process whereas the comparison is based upon recycling all unconverted materials.

EXAMPLE 2

The following data is presented as a second example and compares operations with and without the rejection of the HPNA drag stream. The feed in each case is a vacuum gas oil characterized in Table 3. The operating conditions and the distillate yields are presented in Table 4.

The flow is generally as shown in the Drawing except that the base case operates without employing a PNA removal stream and attempts 100 percent conversion by recycle, and the comparison case employs a different fractionation method to achieve the formation of a small (0.5 wt. % FF) HPNA removal stream. The flow of the comparison case encompasses a small column immediately upstream of the primary product fractionation column. This variation is described above and is highly suitable for use in revamping an existing process unit. This example therefore compares operation of process units operating with and without PNA rejection as required by the subject process.

The improvement attributable to the utilization of the small HPNA drag stream is in this example expressed in terms of catalyst volumes required to provide a catalyst operating life of 18 months (including regeneration). When the PNA rejection column is employed 260 $m^3$ of catalyst is required. Without the PNA rejection column (total recycle) 338 $m^3$ of catalyst is required. The cost of providing the additional catalyst and enlarged reactor is estimated to be about 152 percent greater than the cost of providing the PNA rejection column.

TABLE 3

| VGO FEEDSTOCK | |
|---|---|
| Crude Source: | Murban |
| API | 25.7 |
| Sp. Gr. | 0.9001 |
| IBP °C. | 366 |
| 50% | 443 |
| EP | 542 |
| Sulfur, wt. % | 1.45 |
| Nitrogen, WPPM | 700 |
| Con Carbon, wt. % | 0.1 |
| $C_7$ Insol. wt. % | 0.05 |

TABLE 4

| Operating Data and Yield Structure | |
|---|---|
| Fresh Feed Rate | |
| BPSD | 33,750. |
| $m^3$/hr | 224. |
| $H_2$ Consumpt., $m^3/m^3$ FF | 253. |
| CFR | 1.23 |
| Reactor Pressure, $KG/cm^2g$ | 137. |
| $H_2$/HC, $m^3/m^3$ FF | 1500. |
| Catalyst Life, months | 18. |
| Product Yields* -LV- % Fresh Feed | |
| $C_5/C_6$ (Light Naphtha) | 12.7 |
| $C_7$/149° C. (Heavy Naphtha) | 25.9 |
| 149/288° C. (Kerosene) | 48.1 |
| 288/357° C. (Diesel) | 21.1 |
| Total | 107.8 |

*(Start of Run)

What is claimed:

1. A process for hydrocracking a heavy hydrocarbon feed stream having a 10 percent boiling point above about 316° C., said process comprising the steps of passing said feedstream into a catalytic hydrocracking reaction zone in contact with hydrocracking catalyst comprising at least one metal selected from the group consisting of chromium, nickel, cobalt, platinum, palladium, tungsten and molybdenum, at a temperature above about 316° C. and a total pressure above 1480 kPa, said catalytic hydrocracking reaction zone operating at a feed stream conversion rate above 70 wt. percent with a hydrogen circulation rate in excess at 1777 $m^3/m^3$, to produce a reaction zone effluent stream, subjecting said reaction zone effluent stream to cooling and a vapor-liquid separation to yield a recycle hydrogen stream and a liquid phase stream.

heating said liquid phase stream recovered from said vapor-liquid separation to vaporize at least 90 volume percent of said liquid phase stream, passing said heated and at least partially vaporized liquid phase stream to a fractionation zone wherein said stream is separated into at least a net bottoms stream having a flow rate less than 5 volume percent of the feed stream, a heavy distillate stream which is removed from said fractionation zone at a point above the feedpoint of said stream into the fractionation zone and which has a flow rate equal to 10 to 40 volume percent of the feed stream, and at least one light distillate stream which is removed as the distillate product stream, removing all of said net bottoms stream from said process, and recycling substantially all of said heavy distillate stream to said catalytic hydrocracking zone.

2. The process of claim 1 further characterized in that the heavy distillate stream has boiling point range between about 260–538° C. (500°–1000° F.).

3. The process of claim 2 further characterized in that the light distillate stream has a boiling point range below 376° C. (710° F.).

4. The process of claim 3 further characterized in that a gasoline boiling range distillate stream is also removed from the distillation column.

5. The process of claim 4 further characterized in that the feed stream comprises a vacuum gas oil.

6. A hydrocracking process which comprises the steps of:

(a) passing hydrogen, a recycle stream characterized below and a feed stream into a hydrocracking reaction zone, with the feed stream having a 10 percent boiling point range above about 316° C. (600° F.), with the reaction zone containing a supported catalyst comprising a metal component chosen from the group consisting of chromium, nickel, cobalt, platinum, palladium, tungsten and molybdenum, and with the reaction zone being operated at hydrocracking conditions which include a hydrogen circulation rate in excess of 1,777 std $m^3/m^3$ oil (10,000 std $ft^3$ bbl) and which result in a conversion rate above 70 weight percent and cause the production of a reaction zone effluent stream comprising hydrogen, hydrocracking product hydrocarbons including polynuclear aromatic compounds and unconverted hydrocarbons, with at least 90 wt. percent of the hydrocarbonaceous material in the reaction zone effluent stream exiting the reaction zone as vapor;

(b) separating hydrogen from the reaction zone effluent stream and producing a liquid phase process stream comprising hydrocracking product hydrocarbons including polynuclear aromatic compounds and unconverted hydrocarbons;

(c) heating the liquid phase process stream from step (b) to vaporize at least 90 volume percent of said stream;

(d) passing the process stream from step (c) into a product fractionation zone, with the process stream entering the product fractionation zone being separated into at least a net bottoms stream comprising polynuclear aromatic compounds and having a flow rate less than 5 volume percent of the feed stream, a heavy distillate stream which is removed at a point above the feedpoint of the liquid phase stream to said fractionation zone and which has a flow rate equal to 10 to 40 volume percent of the feed stream, and at least one light distillate stream;

(e) withdrawing the entire net bottoms stream from the process;

(f) passing the entire heavy distillate stream into the reaction zone as said recycle stream; and (g) recovering the light distillate stream as a product stream of the process.

7. The process of claim 6 further characterized in that at least 85 percent of the polynuclear aromatic compounds containing more than 11 benzene rings which enter the product fractionation zone are concentrated into the net bottoms stream.

8. The process of claim 7 further characterized in that the net bottoms stream has a flow rate equal to less than 2 volume percent of the feed stream.

9. The process of claim 6 further characterized in that at least 95 wt. percent of the hydrocarbonaceous material in the reaction zone effluent stream exits the reaction zone as vapor.

10. The process of claim 9 further characterized in that at least 80 wt. percent of the feed stream is converted within the reaction zone.

11. The process of claim 10 further characterized in that at least 90 wt. percent of the feed stream is converted within the reaction zone.

* * * * *